US009121087B2

(12) United States Patent
Matsuda et al.

(10) Patent No.: US 9,121,087 B2
(45) Date of Patent: Sep. 1, 2015

(54) HIGH STRENGTH STEEL SHEET AND METHOD FOR MANUFACTURING THE SAME

(75) Inventors: Hiroshi Matsuda, Tokyo (JP); Yoshimasa Funakawa, Tokyo (JP); Yasushi Tanaka, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 629 days.

(21) Appl. No.: 13/060,115

(22) PCT Filed: Sep. 4, 2009

(86) PCT No.: PCT/JP2009/065877
§ 371 (c)(1),
(2), (4) Date: Feb. 22, 2011

(87) PCT Pub. No.: WO2010/029983
PCT Pub. Date: Mar. 18, 2010

(65) Prior Publication Data

US 2011/0146852 A1 Jun. 23, 2011

(30) Foreign Application Priority Data

Sep. 10, 2008 (JP) ..... 2008-232401
Jul. 31, 2009 (JP) ..... 2009-179953

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/60*** | (2006.01) |
| ***C22C 38/00*** | (2006.01) |
| ***C21D 6/00*** | (2006.01) |
| ***C21D 8/02*** | (2006.01) |

(Continued)

(52) U.S. Cl.
CPC . *C22C 38/04* (2013.01); *C21D 6/00* (2013.01); *C21D 8/0205* (2013.01); *C21D 8/04* (2013.01); *C21D 9/46* (2013.01); *C22C 38/001* (2013.01); *C22C 38/02* (2013.01); *C22C 38/06* (2013.01); *C23C 2/02* (2013.01); *C23C 2/28* (2013.01); *C21D 2211/001* (2013.01); *C21D 2211/002* (2013.01); *C21D 2211/005* (2013.01); *C21D 2211/008* (2013.01)

(58) Field of Classification Search
None
See application file for complete search history.

(56) References Cited

U.S. PATENT DOCUMENTS

2004/0035500 A1 2/2004 Ikeda et al.
2004/0074575 A1 4/2004 Kashima et al.

(Continued)

FOREIGN PATENT DOCUMENTS

EP 2 267 176 A1 12/2010
JP 4-235253 A 8/1992

(Continued)

OTHER PUBLICATIONS

Davis, Surface Engineering of Carbon and Alloy Steels, 5 ASM Handbook 701-740 (1994).*

(Continued)

*Primary Examiner* — Yoshitoshi Takeuchi
(74) *Attorney, Agent, or Firm* — RatnerPrestia

(57) ABSTRACT

A high-strength steel sheet has good ductility and stretch-flangeability and has a tensile strength (TS) of 980 MPa or more. The steel sheet contains 0.17%-0.73% C, 3.0% or less Si, 0.5%-3.0% Mn, 0.1% or less P, 0.07% or less S, 3.0% or less Al, and 0.010% or less N, in which Si+Al is 0.7% or more.

17 Claims, 1 Drawing Sheet

(51) Int. Cl.

| | |
|---|---|
| ***C21D 8/04*** | (2006.01) |
| ***C21D 9/46*** | (2006.01) |
| ***C23C 2/02*** | (2006.01) |
| ***C23C 2/28*** | (2006.01) |

(56) References Cited

U.S. PATENT DOCUMENTS

| | | | | |
|---|---|---|---|---|
| 2008/0283154 | A1 | 11/2008 | Taniguchi et al. | |
| 2009/0277547 | A1 * | 11/2009 | Saito et al. | 148/661 |

FOREIGN PATENT DOCUMENTS

| | | | | | |
|---|---|---|---|---|---|
| JP | 11-256273 | A | | 9/1999 | |
| JP | 2002-302734 | A | | 10/2002 | |
| JP | 2004-076114 | A | | 3/2004 | |
| JP | 2004-308002 | A | | 11/2004 | |
| JP | 2005-200690 | A | | 7/2005 | |
| JP | 2005-336526 | A | | 12/2005 | |
| JP | 2009-209450 | A | | 9/2009 | |
| WO | WO 2008/007785 | | * | 1/2008 | C22C 38/00 |

OTHER PUBLICATIONS

Streicher, A.M. et al., "Quenching and Partitioning Response of a Si-Added TRIP Sheet Steel," Proceedings of the International Conference on Advanced High Strength Sheet Steels for Automotive Applications, Jun. 6-9, 2004, pp. 51-62.

Clarke, A., "Carbon Partitioning Into Austenite From Martensite in a Silicon-Containing High Strength Sheet Steel," Colorado School of Mines Thesis, 2006, pp. i-321.

Clarke, A., Microstructure and Carbon Partitioning in a 0.19% C-1.59%Mn-1.63%Si Trip Sheet Steel Subjected to Quenching and Partitioning (Q&P), Solid-to-Solid Phase Transformations in Inorganic Materials, vol. 2, 2005, pp. 99-108.

Clarke, A.J. et al., "Carbon Partitioning to Austenite from Martensite or Bainite During the Quench and Partition (Q&P) Process: A Critical Assessment," Acta Materialia, vol. 56, No. 1, 2008, pp. 16-22.

Clarke, A.J. et al., "Influence of Carbon Partitioning Kinetics on Final Austenite Fraction During Quenching and Partitioning," Scripts Materialia, vol. 61, No. 2, 2009, pp. 149-152.

Thomas, G.A. et al., "Considerations in the Application of the "Quenching and Partitioning" Concept to Hot Rolled AHSS Production," AIST International Conference on New Developments in Advanced High-Strength Sheet Steels, 2008, pp. 209-217, vol. 5, No. 5.

Thomas, G.A., Simulation of Hot-Rolled Advanced High Strength Sheet Steel Production Using a Gleeble System, Colorado School of Mines Thesis, 2009, pp. i-153.

Santofimia, M.J. et al., "Characterization of the Microstructure Obtained by the Quenching and Partitioning Process in a Low-Carbon Steel," Materials Characterization, vol. 59, No. 12, 2008, pp. 1758-1764.

De Moor, E., "Effect of Retained Austenite Stabilized via Quench and Partitioning on the Strain Hardening of Martensitic Steels," Metallurgical and Materials Transactions A, vol. 39A, No. 11, 2008, pp. 2586-2595.

De Moor, E. et al., "Alloy Design for Enhanced Austenite Stabilization via Quenching and Partitioning," International Conference on New Developments in Advanced High-Strength Sheet Steels, vol. 32, No. 0, 2008, pp. 199-207.

De Moor, E. et al., "Quench & Partitioning Response of a Mo-Alloyed CMNSI Steel," New Developments on Metallurgy and Applications of High Strength Steels, The Minerals, Metals & Materials Society, 2008, pp. 721-729.

De Moor E. et al., "Hole Expansion Properties of Quench & Partition Steels," International Deep Drawing Research Group IDDRG 2009 International Conference, pp. 413-424, Jun. 1-3, 2009.

De Moor E. et al., "Effect of Si, Al and Mo Alloying on Tensile Properties Obtained by Quenching and Partitioning," MS&T 2009, pp. 1554-1563.

* cited by examiner

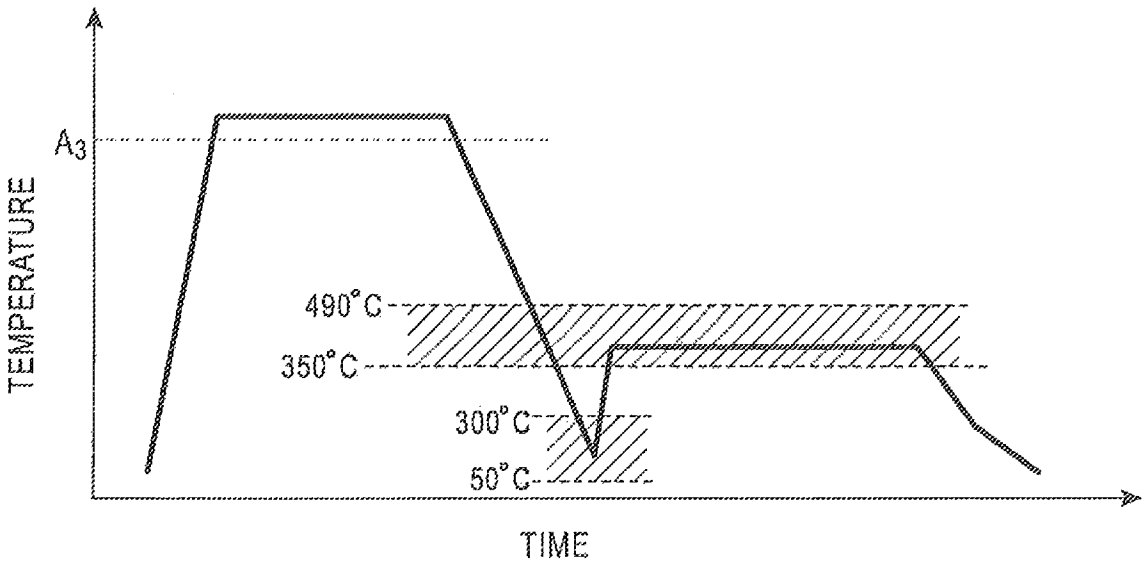
TEMPERATURE
$A_3$
490°C
350°C
300°C
50°C
TIME

HIGH STRENGTH STEEL SHEET AND METHOD FOR MANUFACTURING THE SAME

RELATED APPLICATIONS

This is a §371 of International Application No. PCT/JP2009/065877, with an international filing date of Sep. 4, 2009 (WO 2010/029983 A1, published Mar. 18, 2010), which is based on Japanese Patent Application Nos. 2008-232401, filed Sep. 10, 2008, and 2009-179953, filed Jul. 31, 2009, the subject matter of which is incorporated by reference.

TECHNICAL FIELD

This disclosure relates to a high-strength steel sheet used in industrial fields such as automobiles and electrics and having good workability, in particular, good ductility and stretch-flangeability, and a tensile strength (TS) of 980 MPa or more, and relates to a method for manufacturing the high-strength steel sheet.

BACKGROUND

In recent years, from the viewpoint of global environment conservation, the improvement of fuel efficiency of automobiles has been a critical issue. Development in which an increase in the strength of materials used for automobile bodies reduces thicknesses to lighten automobile bodies has been actively made.

To increase the strength of a steel sheet, in general, it is necessary to increase proportions of hard phases such as martensite and bainite with respect to all microstructures of the steel sheet. However, an increase in the strength of the steel sheet by increasing the proportions of the hard phases causes a reduction in workability. Thus, the development of a steel sheet having both high strength and good workability is required. Hitherto, various composite-microstructure steel sheets, such as ferrite-martensite dual phase steel (DP steel) and TRIP steel utilizing transformation-induced plasticity of retained austenite, have been developed.

In the case where the proportions of the hard phases are increased in a composite-microstructure steel sheet, the workability of the hard phases strongly affects the workability of the steel sheet. The reason for this is as follows: In the case where the proportions of the hard phases are low and where the proportion of soft polygonal ferrite is high, the deformation ability of polygonal ferrite is dominant to the workability of the steel sheet. That is, even in the case of insufficient workability of the hard phases, the workability such as ductility is ensured. In contrast, in the case where the proportions of the hard phases are high, the workability of the steel sheet is directly affected not by the deformation ability of polygonal ferrite but by deformation abilities of the hard phases.

Thus, in the case of a cold-rolled steel sheet, the workability of martensite is improved as follows: Heat treatment for adjusting the amount of polygonal ferrite formed in the annealing step and the subsequent cooling step is performed. The resulting steel sheet is subjected to water quenching to form martensite. The steel sheet is heated and maintained at a high temperature to temper martensite, thereby forming a carbide in martensite as a hard phase. However, such quenching and tempering of martensite require a special manufacturing apparatus such as a continuous annealing apparatus with the function to perform water quenching. Thus, in the case of a usual manufacturing apparatus in which a steel sheet cannot be heated again or maintained at a high temperature after the hardening of the steel sheet, although the steel sheet can be strengthened, the workability of martensite as a hard phase cannot be improved.

As a steel sheet having a hard phase other than martensite, there is a steel sheet having a main phase of polygonal ferrite and hard phases of bainite and pearlite, in which bainite and pearlite as the hard phases contain carbide. The workability of the steel sheet is improved by not only polygonal ferrite but also the formation of carbide in the hard phases to improve the workability of the hard phases. In particular, the steel sheet has improved stretch-flangeability. However, since the main phase is composed of polygonal ferrite, it is difficult to strike a balance between high strength, i.e., a tensile strength (TS) of 980 MPa or more, and workability. Furthermore, in the case where the workability of the hard phases is improved by forming carbide in the hard phases, the workability of the resulting steel sheet is inferior to the workability of polygonal ferrite. Thus, in the case of reducing the amount of polygonal ferrite to achieve a high tensile strength (TS) of 980 MPa or more, sufficient workability cannot be provided.

Japanese Unexamined Patent Application Publication No. 4-235253 discloses a high-strength steel sheet having good bendability and impact resistance. The microstructure of that steel sheet is fine uniform bainite including retained austenite obtained by specifying alloy components.

Japanese Unexamined Patent Application Publication No. 2004-76114 discloses a composite-microstructure steel sheet having good bake hardenability. Microstructures of that steel sheet contain bainite including retained austenite obtained by specifying predetermined alloy components and the retained austenite content of bainite.

Japanese Unexamined Patent Application Publication No. 11-256273 discloses a composite-microstructure steel sheet having good impact resistance obtained by specifying predetermined alloy components and the hardness (HV) of bainite to form microstructures containing 90% or more bainite including retained austenite in terms of the proportion of area and 1%-15% retained austenite in bainite.

However, the steel sheets described above have the problems described below. For example, in the component composition described in JP '253, it is difficult to ensure the amount of stable retained austenite that provides a TRIP effect in a high-strain region when strain is applied to the steel sheet. Although bendability is obtained, ductility until plastic instability occurs is low, thereby leading to low punch stretchability.

In the steel sheet described in JP '114, bake hardenability is obtained. However, in the case of providing a steel sheet having a high tensile strength (TS) of 980 MPa or more or 1050 MPa or more, it is difficult to ensure the strength or workability such as ductility and stretch-flangeability when the steel sheet has increased strength because the steel sheet mainly contains bainite or bainite and ferrite and minimizes martensite.

The steel sheet described in JP '273 aims mainly to improve impact resistance. The steel sheet contains bainite with a hardness HV of 250 or less as a main phase. Specifically, the microstructure of the steel sheet contains more than 90% bainite. Thus, it is difficult to achieve a tensile strength (TS) of 980 MPa or more.

It could therefore be helpful to provide a high-strength steel sheet having good workability, in particular, ductility and stretch-flangeability, and having a tensile strength (TS) of 980 MPa or more, and to provide an advantageous method for manufacturing the steel sheet.

SUMMARY

Our high-strength steel sheets include a steel sheet that is subjected to galvanizing or galvannealing to form coatings on surfaces of the steel sheet.

Good workability as used herein indicates that the value of TS×T. EL is 20,000 MPa·% or more and that the value of TS×λ is 25,000 MPa·% or more, where TS represents a tensile strength (MPa), T. EL represents a total elongation (%), and λ represents a maximum hole-expanding ratio (%).

We studied the component composition of and microstructures of steel sheets and found that a high-strength steel sheet having good workability, in particular, a good balance between strength and ductility and a good balance between strength and stretch-flangeability, and having a tensile strength of 980 MPa or more is obtained by utilizing a martensite microstructure to increase the strength, increasing the C content of the steel sheet to 0.17% or more, which is a high C content, utilizing upper bainite transformation to assuredly ensure retained austenite required to provide the TRIP effect, and transforming part of martensite into tempered martensite.

Furthermore, we studied the amount of martensite, the state of the tempered martensite, the amount of retained austenite, and the stability of retained austenite and found the following: In the case of rapidly cooling a steel sheet annealed in the austenite single-phase region, after martensite is partially formed while the degree of undercooling from a martensitic transformation start temperature, i.e., an Ms point (° C.), is being controlled, upper bainite transformation is utilized with the formation of a carbide suppressed, thus further promoting the stabilization of retained austenite and striking a balance between further improvement in ductility and stretch-flangeability when an increase in strength is performed.

We thus provide:

1. A high-strength steel sheet contains, on a mass percent basis:
   0.17%-0.73% C;
   3.0% or less Si;
   0.5%-3.0% Mn;
   0.1% or less P;
   0.07% or less S;
   3.0% or less Al;
   0.010% or less N; and
   the balance being Fe and incidental impurities, in which Si+Al satisfies 0.7% or more, and
   in which with respect to microstructures of the steel sheet, the proportion of the area of martensite is in the range of 10% to 90% with respect to all microstructures of the steel sheet, the retained austenite content is in the range of 5% to 50%, the proportion of the area of bainitic ferrite in upper bainite is 5% or more with respect to all microstructures of the steel sheet, 25% or more of the martensite is tempered martensite, the sum of the proportion of the area of martensite with respect to all microstructures of the steel sheet, the retained austenite content, and the proportion of the area of bainitic ferrite in upper bainite with respect to all microstructures of the steel sheet satisfies 65% or more, the proportion of the area of polygonal ferrite with respect to all microstructures of the steel sheet satisfies 10% or less (including 0%), the average C content of retained austenite is 0.70% or more, and the tensile strength is 980 MPa or more.
2. In the high-strength steel sheet described in item 1, $5\times10^4$ or more per square millimeter of iron-based carbide grains each having a size of 5 nm to 0.5 μm are precipitated in tempered martensite.
3. The high-strength steel sheet described in item 1 or 2 further contains, on a mass percent basis, one or two or more selected from
   0.05%-5.0% Cr;
   0.005%-1.0% V; and
   0.005%-0.5% Mo,
   with the proviso that the C content is 0.17% or more and less than 0.3%.
4. The high-strength steel sheet described in any one of items 1 to 3 further contains, on a mass percent basis, one or two selected from
   0.01%-0.1% Ti; and
   0.01%-0.1% Nb.
5. The high-strength steel sheet described in any one of items 1 to 4 further contains, on a mass percent basis,
   0.0003%-0.0050% B.
6. The high-strength steel sheet described in any one of items 1 to 5 further contains, on a mass percent basis, one or two selected from
   0.05%-2.0% Ni; and
   0.05%-2.0% Cu.
7. The high-strength steel sheet described in any one of items 1 to 6 further contains, on a mass percent basis, one or two selected from
   0.001%-0.005% Ca; and
   0.001%-0.005% REM.
8. A high-strength steel sheet includes a hot-dip zinc coating layer or an alloyed hot-dip zinc coating layer on a surface of the steel sheet described in any one of items 1 to 7.
9. A method for manufacturing a high-strength steel sheet includes hot-rolling and then cold-rolling a billet to be formed into a steel sheet having the composition described in any one of items 1 to 7 to form a cold-rolled steel sheet, annealing the cold-rolled steel sheet in an austenite single-phase region for 15 seconds to 600 seconds, cooling the cold-rolled steel sheet to a first temperature range of 50° C. to 300° C. at an average cooling rate of 8° C./s or more, heating the cold-rolled steel sheet to a second temperature range of 350° C. to 490° C., and maintaining the cold-rolled steel sheet at the second temperature range for 5 seconds to 1000 seconds.
10. In the method for manufacturing a high-strength steel sheet described in item 9, a martensitic transformation start temperature, i.e., an Ms point (° C.), is used as an index, the first temperature range is (Ms−100° C.) or more and less than Ms, and the steel sheet is maintained in the second temperature range for 5 seconds to 600 seconds.
11. In the method for manufacturing a high-strength steel sheet described in item 9 or 10, galvanizing treatment or galvannealing treatment is performed while heating the steel sheet to the second temperature range or while maintaining the steel sheet in the second temperature range.

It is thus possible to provide a high-strength steel sheet having good workability, in particular, good ductility and stretch-flangeability, and having a tensile strength (TS) of 980 MPa or more. Thus, the steel sheet is extremely valuable in industrial fields such as automobiles and electrics. In particular, the steel sheet is extremely useful for a reduction in the weight of automobiles.

BRIEF DESCRIPTION OF THE DRAWING

FIG. 1 is a temperature pattern of heat treatment in our manufacturing method.

DETAILED DESCRIPTION

First, the reason microstructures of a steel sheet are limited to the above-described microstructures will be described. Hereinafter, the proportion of area is defined as the proportion of area with respect to all microstructures of the steel sheet.

Proportion of Area of Martensite: 10% to 90%

Martensite is a hard phase and a microstructure needed to increase the strength of a steel sheet. At a proportion of the area of martensite of less than 10%, the tensile strength (TS) of a steel sheet does not satisfy 980 MPa. A proportion of the area of martensite exceeding 90% results in a reduction in the amount of the upper bainite, so that the amount of stable retained austenite having an increased C content cannot be ensured, thereby disadvantageously reducing workability such as ductility. Thus, the proportion of the area of martensite is in the range of 10% to 90%, preferably 15% to 90%, more preferably 15% to 85%, and still more preferably 15% to 75% or less.

Proportion of Tempered Martensite in Martensite: 25% or More

In the case where the proportion of tempered martensite in martensite is less than 25% with respect to the whole of martensite present in a steel sheet, the steel sheet has a tensile strength of 980 MPa or more but poor stretch-flangeability. Tempering as-quenched martensite that is very hard and has low ductility improves the ductility of martensite and workability, in particular, stretch-flangeability, thereby achieving a value of TS×λ of 25,000 MPa·% or more. Furthermore, the hardness of as-quenched martensite is significantly different from that of upper bainite. A small amount of tempered martensite and a large amount of as-quenched martensite increases boundaries between as-quenched martensite and upper bainite. Minute voids are generated at the boundaries between as-quenched martensite and upper bainite during, for example, punching. The voids are connected to one another to facilitate the propagation of cracks during stretch flanging performed after punching, thus further deteriorating stretch-flangeability. Accordingly, the proportion of tempered martensite in martensite is 25% or more and preferably 35% or more with respect to the whole of martensite present in a steel sheet. Tempered martensite is observed with SEM or the like as a microstructure in which fine carbide grains are precipitated in martensite. Tempered martensite can be clearly distinguished from as-quenched martensite that does not include such carbide in martensite.

Retained Austenite Content: 5% to 50%

Retained austenite is transformed into martensite by a TRIP effect during processing. An increased strain-dispersing ability improves ductility.

Retained austenite having an increased carbon content is formed in upper bainite utilizing upper bainitic transformation. It is thus possible to obtain retained austenite that can provide the TRIP effect even in a high strain region during processing. Use of the coexistence of retained austenite and martensite results in satisfactory workability even in a high-strength region where a tensile strength (TS) is 980 MPa or more. Specifically, it is possible to obtain a value of TS×T. EL of 20,000 MPa·% or more and a steel sheet with a good balance between strength and ductility.

Retained austenite in upper bainite is formed between laths of bainitic ferrite in upper bainite and is finely distributed. Thus, many measurements are needed at high magnification to determine the amount (the proportion of the area) of retained austenite in upper bainite by observation of microstructures, and accurate quantification is difficult. However, the amount of retained austenite formed between laths of bainitic ferrite is comparable to the amount of bainitic ferrite to some extent. We found that in the case where the proportion of the area of bainitic ferrite in upper bainite is 5% or more and where the retained austenite content determined from an intensity measurement by X-ray diffraction (XRD), which is a common technique for measuring the retained austenite content, specifically, determined from the intensity ratio of ferrite to austenite obtained by X-ray diffraction, is 5% or more, it is possible to provide a sufficient TRIP effect and achieve a tensile strength (TS) of 980 MPa or more and a value of TS×T. EL of 20,000 MPa·% or more. Note that it is confirmed that the retained austenite content determined by the common technique for measuring the amount of retained austenite is comparable to the proportion of the area of retained austenite with respect to all microstructures of the steel sheet.

A retained austenite content of less than 5% does not result in a sufficient TRIP effect. On the other hand, a retained austenite content exceeding 50% results in an excessive amount of hard martensite formed after the TRIP effect is provided, disadvantageously reducing toughness and the like. Accordingly, the retained austenite content is set in the range of 5% to 50%, preferably more than 5%, more preferably 10% to 45%, and still more preferably 15% to 40%.

Average C Content of Retained Austenite: 0.70% or More

To obtain good workability by utilizing a TRIP effect, the C content of retained austenite is important for a high-strength steel sheet with a tensile strength (TS) of 980 MPa to 2.5 GPa. Retained austenite formed between laths of bainitic ferrite in upper bainite has an increased C content. It is difficult to correctly evaluate the increased C content of retained austenite between the laths. However, we found that, in the case where the average C content of retained austenite determined from the shift amount of a diffraction peak obtained by X-ray diffraction (XRD), which is a common technique for measuring the average C content of retained austenite (average of the C content of retained austenite), is 0.70% or more, good workability is obtained.

At an average C content of retained austenite of less than 0.70%, martensitic transformation occurs in a low-strain region during processing, so that the TRIP effect to improve workability in a high-strain region is not provided. Accordingly, the average C content of retained austenite is set to 0.70% or more and preferably 0.90% or more. On the other hand, an average C content of retained austenite exceeding 2.00% results in excessively stable retained austenite, so that martensitic transformation does not occur, i.e., the TRIP effect is not provided, during processing, thereby reducing ductility. Accordingly, the average C content of retained austenite is preferably set to 2.00% or less and more preferably 1.50% or less.

Proportion of Area of Bainitic Ferrite in Upper Bainite: 5% or More

The formation of bainitic ferrite resulting from upper bainitic transformation is needed to increase the C content of untransformed austenite and form retained austenite that provides the TRIP effect in a high-strain region during processing to increase a strain-dispersing ability. Transformation from austenite to bainite occurs in a wide temperature range of about 150° C. to about 550° C. Various types of bainite are formed in this temperature range. In the related art, such various types of bainite are often simply defined as bainite.

However, to achieve target workability, the bainite microstructures need to be clearly defined. Thus, upper bainite and lower bainite are defined as follows.

Upper bainite is composed of lath bainitic ferrite and retained austenite and/or carbide present between laths of bainitic ferrite and is characterized in that fine carbide grains regularly arranged in lath bainitic ferrite are not present. Meanwhile, lower bainite is composed of lath bainitic ferrite and retained austenite and/or carbide present between laths of bainitic ferrite, which are the same as those of upper bainite, and is characterized in that fine carbide grains regularly arranged in lath bainitic ferrite are present.

That is, upper bainite and lower bainite are distinguished by the presence or absence of the fine carbide grains regularly arranged in bainitic ferrite. Such a difference of the formation state of carbide in bainitic ferrite has a significant effect on an increase in the C content of retained austenite. That is, in the case of a proportion of the area of bainitic ferrite in upper bainite of less than 5%, the amount of C precipitated as a carbide in bainitic ferrite is increased even when bainitic transformation proceeds. Thus, the C content of retained austenite present between laths is reduced, so that the amount of retained austenite that provides the TRIP effect in a high-strain region during processing is disadvantageously reduced. Accordingly, the proportion of the area of bainitic ferrite in upper bainite needs to be 5% or more with respect to all microstructures of a steel sheet. On the other hand, a proportion of the area of bainitic ferrite in upper bainite exceeding 85% with respect to all microstructures of the steel sheet may result in difficulty in ensuring strength. Hence, the proportion is preferably 85% or less and more preferably 67% or less.

Sum of Proportion of Area of Martensite, Retained Austenite Content, and Proportion of Area of Bainitic Ferrite in Upper Bainite: 65% or More It is insufficient that the proportion of the area of martensite, the retained austenite content, and the proportion of the area of bainitic ferrite in upper bainite just satisfy the respective ranges described above. Furthermore, the sum of the proportion of the area of martensite, the retained austenite content, and the proportion of the area of bainitic ferrite in upper bainite needs to be 65% or more. A sum of less than 65% causes insufficient strength and/or a reduction in workability. Thus, the sum is preferably 70% or more and more preferably 80% or more.

Carbide in Tempered Martensite: $5\times10^4$ or More Per Square Millimeter of Iron-Based Carbide Grains Each Having a Size of 5 nm to 0.5 μm As described above, tempered martensite is distinguished from as-quenched martensite, in which carbide is not precipitated, in that fine carbide is precipitated in the tempered martensite. Workability, in particular, a balance between strength and ductility and a balance between strength and stretch-flangeability, is provided by partially changing martensite into tempered martensite while a tensile strength of 980 MPa or more is ensured. However, in the case of an inappropriate type or grain diameter of carbide precipitated in tempered martensite or an insufficient amount of carbide precipitated, an advantageous effect resulting from tempered martensite is not provided, in some cases. Specifically, less than $5\times10^4$ per square millimeter of iron-based carbide grains each having 5 nm to 0.5 μm result in a tensile strength of 980 MPa or more but are liable to lead to reduced stretch-flangeability and workability. Accordingly, $5\times10^4$ or more per square millimeter of iron-based carbide grains each having a size of 5 nm to 0.5 μm are preferably precipitated in tempered martensite. Iron-based carbide is mainly $Fe_3C$ and sometimes contains an ϵ carbide and the like. The reason why iron-based carbide grains each having a size of less than 5 nm and iron-based carbide grains each having a size exceeding 0.5 μm are not considered is that such iron-based carbide grains do not contribute to improvement in workability.

Proportion of Area of Polygonal Ferrite: 10% or Less (including 0%)

A proportion of the area of polygonal ferrite exceeding 10% causes difficulty in satisfying a tensile strength (TS) of 980 MPa or more. Furthermore, strain is concentrated on soft polygonal ferrite contained in a hard microstructure during processing to readily forming cracks during processing, so that a desired workability is not provided. At a proportion of the area of polygonal ferrite of 10% or less, a small amount of polygonal ferrite grains are separately dispersed in a hard phase even when polygonal ferrite is present, thereby suppressing the concentration of strain and preventing a deterioration in workability. Accordingly, the proportion of the area of polygonal ferrite is set to 10% or less, preferably 5% or less, and more preferably 3% or less, and may be 0%.

The hardest microstructure in the microstructures of the steel sheet has a hardness (HV) of 800 or less. That is, in the case where as-quenched martensite is present, as-quenched martensite is defined as the hardest microstructure and has a hardness (HV) of 800 or less. Significantly hard martensite with a hardness (HV) exceeding 800 is not present, thus ensuring good stretch-flangeability. In the case where as-quenched martensite is not present and where tempered martensite and upper bainite are present or where lower bainite is further present, any one of the microstructures including lower bainite is the hardest phase. Each of the microstructures is a phase with a hardness (HV) of 800 or less.

The steel sheet may further contain pearlite, Widmanstatten ferrite, and lower bainite as a balance microstructure. In this case, the acceptable content of the balance microstructure is preferably 20% or less and more preferably 10% or less in terms of the proportion of area.

The reason why the component composition of a steel sheet is limited to that described above is described below. Note that "%" used in the component composition indicates % by mass.

C: 0.17% to 0.73%

C is an essential element for ensuring a steel sheet with higher strength and a stable retained austenite content. Furthermore, C is an element needed to ensure the martensite content and allow austenite to remain at room temperature. A C content of less than 0.17% causes difficulty in ensuring the strength and workability of the steel sheet. On the other hand, a C content exceeding 0.73% causes a significant hardening of welds and heat-affected zones, thereby reducing weldability. Thus, the C content is set in the range of 0.17% to 0.73%. Preferably, the C content is more than 0.20% and 0.48% or less and more preferably 0.25% or more and 0.48% or less.

Si: 3.0% or Less (Including 0%)

Si is a useful element that contributes to improvement in steel strength by solid-solution strengthening. However, a Si content exceeding 3.0% causes deterioration in workability and toughness due to an increase in the amount of Si dissolved in polygonal ferrite and bainitic ferrite, the deterioration of a surface state due to the occurrence of red scale and the like, and deterioration in the adhesion of a coating when hot dipping is performed. Therefore, the Si content is set to 3.0% or less, preferably 2.6%, and more preferably 2.2% or less.

Furthermore, Si is a useful element that suppresses the formation of a carbide and promotes the formation of retained austenite. Hence, the Si content is preferably 0.5% or more. In the case where the formation of a carbide is suppressed by Al alone, Si need not be added. In this case, the Si content may be 0%.

Mn: 0.5% to 3.0%

Mn is an element effective in strengthening steel. A Mn content of less than 0.5% results in, during cooling after annealing, the precipitation of a carbide at temperatures higher than a temperature at which bainite and martensite are formed, so that the amount of a hard phase that contributes to the strengthening of steel cannot be ensured. On the other hand, a Mn content exceeding 3.0% causes a deterioration in, for example, castability. Thus, the Mn content is in the range of 0.5% to 3.0% and preferably 1.0% to 2.5%.

P: 0.1% or Less

P is an element effective in strengthening steel. A P content exceeding 0.1% causes embrittlement due to grain boundary segregation, thereby degrading impact resistance. Furthermore, in the case where a steel sheet is subjected to galvannealing, the rate of alloying is significantly reduced. Thus, the P content is set to 0.1% or less and preferably 0.05% or less. The P content is preferably reduced. However, to achieve a P content of less than 0.005%, an extremely increase in cost is required. Thus, the lower limit of the P content is preferably set to about 0.005%.

S: 0.07% or Less

S is formed into MnS as an inclusion that causes a deterioration in impact resistance and causes cracks along a flow of a metal in a weld zone. Thus, the S content is preferably minimized. However, an excessive reduction in S content increases the production cost. Therefore, the S content is set to 0.07% or less, preferably 0.05% or less, and more preferably 0.01% or less. To achieve a S content of less than 0.0005%, an extremely increase in cost is required. From the viewpoint of the production cost, the lower limit of the S content is set to about 0.0005%.

Al: 3.0% or Less

Al is a useful element that is added as a deoxidizer in a steel making process. An Al content exceeding 3.0% causes an increase in the amount of inclusions in a steel sheet, thereby reducing ductility. Thus, the Al content is set to 3.0% or less and preferably 2.0% or less.

Furthermore, Al is a useful element that suppresses the formation of a carbide and promotes the formation of retained austenite. To provide a deoxidation effect, the Al content is preferably set to 0.001% or more and more preferably 0.005% or more. Note that the Al content is defined as the Al content of a steel sheet after deoxidation.

N: 0.010% or Less

N is an element that most degrades the aging resistance of steel. Thus, the N content is preferably minimized. A N content exceeding 0.010% causes significant degradation in aging resistance. Thus, the N content is set to 0.010% or less. To achieve a N content of less than 0.001%, an extremely increase in production cost is required. Therefore, from the viewpoint of the production cost, the lower limit of the N content is set to about 0.001%.

The fundamental components have been described above. It is insufficient that the composition ranges described above are just satisfied. That is, the next expression needs to be satisfied:

Si+Al: 0.7% or More.

Both Si and Al are, as described above, useful elements each suppressing the formation of a carbide and promoting the formation of retained austenite. Although the incorporation of Si or Al alone is effective in suppressing the formation of the carbide, the total amount of Si and Al needs to satisfy 0.7% or more. Note that the Al content shown in the above-described expression is defined as the Al content of a steel sheet after deoxidation.

The following components may be appropriately contained in addition to the fundamental components described above:

One or two or more selected from 0.05%-5.0% Cr, 0.005%-1.0% V, and 0.005%-0.5% Mo, with the proviso that the C content is 0.17% or more and less than 0.3%.

The case where an increase in strength is needed while weldability is ensured or the case where stretch-flangeability needs to be emphasized is assumed in response to applications of a high-strength steel sheet. Stretch-flangeability and weldability are degraded with increasing C content. Meanwhile, a simple reduction in C content to ensure stretch-flangeability and weldability reduces the strength of a steel sheet, so that it is sometimes difficult to ensure strength required for applications of the steel sheet. To solve those problems, we studied the component composition of steel sheets and found that a reduction in C content to less than 0.3% results in satisfactory stretch-flangeability and weldability. Furthermore, the reduction in C content reduces the strength of a steel sheet. However, it was also found that the incorporation of any one of Cr, V, and Mo, which are elements suppressing the formation of pearlite, in a predetermined amount during cooling from an annealing temperature provides the effect of improving the strength of a steel sheet. The effect is provided at a Cr content of 0.05% or more, a V content of 0.005% or more, or a Mo content of 0.005% or more. Meanwhile, a Cr content exceeding 5.0%, a V content exceeding 1.0%, or a Mo content exceeding 0.5% results in an excess amount of hard martensite, thus leading to high strength more than necessary. Thus, in the case of incorporating Cr, V, and Mo, the Cr content is set in the range of 0.05% to 5.0%, the V content is set in the range of 0.005% to 1.0%, and the Mo content is set in the range of 0.005% to 0.5%.

One or Two Selected from 0.01%-0.1% Ti and 0.01%-0.1% Nb

Ti and Nb are effective for precipitation strengthening. The effect is provided when Ti or Nb is contained in an amount of 0.01% or more. In the case where Ti or Nb is contained in an amount exceeding 0.1%, workability and shape fixability are reduced. Thus, in the case of incorporating Ti and Nb, the Ti content is set in the range of 0.01% to 0.1%, and the Nb content is set in the range of 0.01% to 0.1%.

B: 0.0003% to 0.0050%

B is a useful element that has the effect of suppressing the formation and growth of polygonal ferrite from austenite grain boundaries. The effect is provided when B is contained in an amount of 0.0003% or more. Meanwhile, a B content exceeding 0.0050% causes a reduction in workability. Thus, in the case of incorporating B, the B content is set in the range of 0.0003% to 0.0050%.

One or Two Selected from 0.05%-2.0% Ni and 0.05%-2.0% Cu

Ni and Cu are each an element effective in strengthening steel. Furthermore, in the case where a steel sheet is subjected to galvanizing or galvannealing, internal oxidation is promoted in surface portions of the steel sheet, thereby improving the adhesion of a coating. These effects are provided when Ni or Cu is contained in an amount of 0.05% or more. Meanwhile, in the case where Ni or Cu is contained in an amount exceeding 2.0%, the workability of the steel sheet is reduced. Thus, in the case of incorporating Ni and Cu, the Ni content is set in the range of 0.05% to 2.0%, and the Cu content is set in the range of 0.05% to 2.0%.

One or Two Selected from 0.001%-0.005% Ca and 0.001%-0.005% REM

Ca and REM are effective in spheroidizing the shape of a sulfide and improving an adverse effect of the sulfide on stretch-flangeability. The effect is provided when Ca or REM is contained in an amount of 0.001% or more. Meanwhile, in the case where Ca or REM is contained in an amount exceeding 0.005%, inclusions and the like are increased to cause, for example, surface defects and internal defects. Thus, in the case of incorporating Ca and REM, the Ca content is set in the range of 0.001% to 0.005%, and the REM content is set in the range of 0.001% to 0.005%.

Components other than the components described above are Fe and incidental impurities. However, a component other than the components described above may be contained to the extent that the effect desired is not impaired.

Next, a method for manufacturing a high-strength steel sheet will be described.

After a billet adjusted to have a preferred composition described above is produced, the billet is subjected to hot rolling and then cold rolling to form a cold-rolled steel sheet. These treatments are not particularly limited and may be performed according to common methods.

Preferred conditions of manufacture are as follows. After the billet is heated to a temperature range of 1000° C. to 1300° C., hot rolling is completed in the temperature range of 870° C. to 950° C. The resulting hot-rolled steel sheet is wound in the temperature range of 350° C. to 720° C. The hot-rolled steel sheet is subjected to pickling and then cold rolling at a rolling reduction of 40% to 90% to form a cold-rolled steel sheet.

A steel sheet is assumed to be manufactured through common steps, i.e., steelmaking, casting, hot rolling, pickling, and cold rolling. Alternatively, in the manufacture of a steel sheet, a hot-rolling step may be partially or entirely omitted by performing thin-slab casting, strip casting, or the like.

The resulting cold-rolled steel sheet is subjected to heat treatment shown in FIG. 1. Hereinafter, the description will be performed with reference to FIG. 1.

The cold-rolled steel sheet is annealed in an austenite single-phase region for 15 seconds to 600 seconds. A steel sheet mainly has a low-temperature transformation phase formed by transforming untransformed austenite such as upper bainite and martensite. Preferably, polygonal ferrite is minimized. Thus, annealing is needed in the austenite single-phase region. The annealing temperature is not particularly limited as long as annealing is performed in the austenite single-phase region. An annealing temperature exceeding 1000° C. results in significant growth of austenite grains, thereby causing an increase in the size of a phase structure formed during the subsequent cooling and degrading toughness and the like. Meanwhile, at an annealing temperature of less than $A_3$ point (austenitic transformation point), polygonal ferrite is already formed in the annealing step. To suppress the growth of polygonal ferrite during cooling, it is necessary to rapidly cool the steel sheet by a temperature range of 500° C. or more. Thus, the annealing temperature needs to be the $A_3$ point (austenitic transformation point) or more and 1000° C. or less.

At an annealing time of less than 15 seconds, in some cases, reverse austenitic transformation does not sufficiently proceed, and a carbide in the steel sheet is not sufficiently dissolved. Meanwhile, an annealing time exceeding 600 seconds leads to an increase in cost due to large energy consumption. Thus, the annealing time is set in the range of 15 seconds to 600 seconds and preferably 60 seconds to 500 seconds. The $A_3$ point can be approximately calculated as follows:

$$A_3 \text{ point } (^\circ \text{C.}) = 910 - 203 \times [\text{C } \%]^{1/2} + 44.7 \times [\text{Si } \%] - 30 \times [\text{Mn } \%] + 700 \times [\text{P } \%] + 130 \times [\text{Al } \%] - 15.2 \times [\text{Ni } \%] - 11 \times [\text{Cr } \%] - 20 \times [\text{Cu } \%] + 31.5 \times [\text{Mo } \%] + 104 \times [\text{V } \%] + 400 \times [\text{Ti } \%]$$

where [X %] is defined as percent by mass of a constituent element X in the steel sheet.

The cold-rolled steel sheet after annealing is cooled to a first temperature range of 50° C. to 300° C. at a regulated average cooling rate of 8° C./s or more. This cooling serves to transform part of austenite into martensite by cooling the steel sheet to a temperature of less than a Ms point. In the case where the lower limit of the first temperature range is less than 50° C., most of untransformed austenite is transformed into martensite at this point, so that the amount of upper bainite (bainitic ferrite and retained austenite) cannot be ensured. Meanwhile, in the case where the upper limit of the first temperature range exceeds 300° C., an appropriate amount of tempered martensite cannot be ensured. Thus, the first temperature range is set in the range of 50° C. to 300° C., preferably 80° C. to 300° C., and more preferably 120° C. to 300° C. An average cooling rate of less than 8° C./s causes an excessive formation and growth of polygonal ferrite and the precipitation of pearlite and the like, so that desired microstructures of a steel sheet are not obtained. Thus, the average cooling rate from the annealing temperature to the first temperature range is set to 8° C./s or more and preferably 10° C./s or more. The upper limit of the average cooling rate is not particularly limited as long as a cooling stop temperature is not varied. In general equipment, an average cooling rate exceeding 100° C./s causes significant nonuniformity of microstructures in the longitudinal and width directions of a steel sheet. Thus, the average cooling rate is preferably 100° C./s or less. Hence, the average cooling rate is preferably in the range of 10° C./s to 100° C./s. A heating step after the completion of cooling is not particularly specified. In the case where transformation behavior, such as upper bainite transformation including the formation of a carbide, disadvantageous to the desired effect occurs, preferably, the steel sheet is immediately heated to a second temperature range described below without being maintained at the cooling stop temperature. Thus, as a cooling means, gas cooling, oil cooling, cooling with a low-melting-point-liquid metal, and the like are recommended.

Furthermore, we studied the relationship between the state of tempered martensite and retained austenite and found the following: In the case of rapidly cooling a steel sheet annealed in the austenite single-phase region, a martensitic transformation start temperature, i.e., an Ms point (° C.), is used as an index. After martensite is partially formed while the degree of undercooling from the Ms point is being controlled, upper bainite transformation is utilized with the formation of a carbide suppressed, thus further promoting the stabilization of retained austenite. Simultaneously, the tempering of martensite formed in the first temperature range strikes a balance between further improvement in ductility and stretch-flangeability when an increase in strength is performed. Specifically, the foregoing effect utilizing the degree of undercooling is provided by controlling the first temperature range to a temperature of (Ms−100° C.) or more and less than Ms. Note that cooling the annealed steel sheet to less than (Ms−100° C.) causes most of untransformed austenite to be transformed into martensite, which may not ensure the amount of upper bainite (bainitic ferrite and retained austenite). Undercooling does not readily occur in the cooling step of the annealed steel sheet to the first temperature range as the Ms point is reduced.

In the current cooling equipment, it is sometimes difficult to ensure the cooling rate. To sufficiently provide the foregoing effect utilizing the degree of undercooling, for example, the Ms point is preferably 100° C. or higher. The reason the foregoing effect is provided is not clear but is believed that in the case where martensite is formed with the degree of undercooling optimally controlled, martensitic transformation and the subsequent tempering of martensite by heating and maintaining the steel sheet at a bainite-forming-temperature range (second temperature range described below) impart appropriate compressive stress to untransformed austenite, thereby further promoting the stabilization of retained austenite. As a result, deformation behavior is optimized in combination with tempered martensite with workability ensured by the formation in the first temperature range and then the tempering in the second temperature range.

In the case where cooling is performed in the range of 50° C. to (Ms−50° C.), the average cooling rate from (Ms+20° C.) to (Ms−50° C.) is preferably regulated to be 8° C./s to 50° C./s for the viewpoint of achieving the stabilization of the shape of a steel sheet. At an average cooling rate exceeding 50° C./s, martensitic transformation proceeds rapidly. If the cooling stop temperature is not varied in the steel sheet, the final amount of martensitic transformation is not varied in the steel sheet. However, in general, the occurrence of a temperature difference in the steel sheet (in particular, in the width direction) due to rapid cooling causes nonuniformity in martensitic transformation start time in the steel sheet. Thus, in the case where martensitic transformation proceeds rapidly, even if the temperature difference is very small, large differences in strain and stress generated in the steel sheet are generated by the nonuniformity in martensitic transformation start time, thereby degrading the shape. Therefore, the average cooling rate is preferably set to 50° C./s or less and more preferably 45° C./s or less.

The above-described Ms point can be approximately determined by an empirical formula and the like but is desirably determined by actual measurement using a Formaster test or the like.

The steel sheet cooled to the first temperature range is heated to the second temperature range of 350° C. to 490° C. and maintained at the second temperature range for 5 seconds to 1000 seconds. Preferably, the steel sheet cooled to the first temperature range is immediately heated without being maintained at a cooling stop temperature to suppress transformation behavior such as lower bainite transformation including the formation of a carbide which is disadvantageous. In the second temperature range, martensite formed by the cooling from the annealing temperature to the first temperature range is tempered, and untransformed austenite is transformed into upper bainite. In the case where the upper limit of the second temperature range exceeds 490° C., a carbide is precipitated from the untransformed austenite, so that a desired microstructure is not obtained. Meanwhile, in the case where the lower limit of the second temperature range is less than 350° C., lower bainite is formed in place of upper bainite, thereby disadvantageously reducing the C content of austenite. Thus, the second temperature range is set in the range of 350° C. to 490° C. and preferably 370° C. to 460° C.

A holding time in the second temperature range of less than 5 seconds leads to insufficient tempering of martensite and insufficient upper bainite transformation, so that a steel sheet does not have a desired microstructures, thereby resulting in poor workability of the steel sheet. Meanwhile, a holding time in the second temperature range exceeding 1000 seconds does not result in stable retained austenite with an increased C content obtained by precipitation of a carbide from untransformed austenite to be formed into retained austenite as a final microstructure of the steel sheet. As a result, desired strength and/or ductility is not obtained. Thus, the holding time is set in the range of 5 seconds to 1000 seconds, preferably 15 seconds to 600 seconds, and more preferably 40 seconds to 400 seconds.

In the heat treatment, the holding temperature need not be constant as long as it is within the predetermined temperature range described above. No real problems arise even if the holding temperature is varied within a predetermined temperature range. The same is true for the cooling rate. Furthermore, a steel sheet may be subjected to the heat treatment with any apparatus as long as heat history is just satisfied. Moreover, after heat treatment, subjecting surfaces of the steel sheet to surface treatment such as skin pass rolling or electroplating for shape correction is possible.

The method for manufacturing a high-strength steel sheet may further include galvanizing or galvannealing in which alloying treatment is performed after galvanizing.

Galvanizing or galvannealing may be performed while heating the steel sheet from the first temperature range to the second temperature range, while holding the steel sheet in the second temperature range, or after the holding the steel sheet in the second temperature range. In any case, holding conditions in the second temperature range are required to satisfy the requirements of our steel sheets and methods. The holding time, which includes a treatment time for galvanizing or galvannealing, in the second temperature range is set in the range of 5 seconds to 1000 seconds. Note that galvanizing or galvannealing is preferably performed on a continuous galvanizing and galvannealing line.

In the method for manufacturing a high-strength steel sheet, after the high-strength steel sheet that has been subjected to heat treatment according to the manufacturing method is manufactured, the steel sheet may be subjected to galvanizing or galvannealing.

A method for subjecting a steel sheet to galvanizing or galvannealing is described below.

A steel sheet is immersed in a plating bath. The coating weight is adjusted by gas wiping or the like. The amount of molten Al in the plating bath is preferably in the range of 0.12% to 0.22% for galvanizing and 0.08% to 0.18% for galvannealing.

With respect to the treatment temperature, for galvanizing, the temperature of the plating bath may be usually in the range of 450° C. to 500° C. In the case of further subjecting the steel sheet to alloying treatment, the temperature during alloying is preferably set to 550° C. or lower. If the alloying temperature exceeds 550° C., a carbide is precipitated from untransformed austenite. In some cases, pearlite is formed, so that strength and/or workability is not provided. Furthermore, anti-powdering properties of a coating layer are impaired. Meanwhile, at an alloying temperature of less than 450° C., alloying does not proceed, in some cases. Thus, the alloying temperature is preferably set to 450° C. or higher.

The coating weight is preferably in the range of 20 g/m$^2$ to 150 g/m$^2$ per surface. A coating weight of less than 20 g/m$^2$ leads to insufficient corrosion resistance. Meanwhile, a coating weight exceeding 150 g/m$^2$ leads to saturation of the corrosion resistance, merely increasing the cost.

The degree of alloying of the coating layer (% by mass of Fe (Fe content)) is preferably in the range of 7% by mass to 15% by mass. A degree of alloying of the coating layer of less than 7% by mass causes uneven alloying, thereby reducing the quality of appearance. Furthermore, the ξ phase is formed in the coating layer, degrading the slidability of the steel sheet. Meanwhile, a degree of alloying of the coating layer exceeding 15% by mass results in the formation of a large amount of the hard brittle F phase, thereby reducing adhesion of the coating.

EXAMPLES

Our steel sheets and methods will be described in further detail by examples. Those steel sheets and methods are not limited to these examples. It will be understood that modification may be made without changing the scope of this disclosure and the appended claims.

Example 1

A cast slab obtained by refining steel having a chemical composition shown in Table 1 was heated to 1200° C. A hot-rolled steel sheet was subjected to finish hot rolling at 870° C., wound at 650° C., pickling, and cold rolling at a rolling reduction of 65% to form a cold-rolled steel sheet with a thickness of 1.2 mm. The resulting cold-rolled steel sheet was subjected to heat treatment under conditions shown in Table 2. Note that the cooling stop temperature T shown in Table 2 is defined as a temperature at which the cooling of the steel sheet is terminated when the steel sheet is cooled from the annealing temperature.

Some cold-rolled steel sheets were subjected to galvanizing treatment or galvannealing treatment. In the galvanizing treatment, both surfaces were subjected to plating in a plating bath having a temperature of 463° C. at a weight of 50 g/m$^2$ per surface. In the galvannealing treatment, both surfaces were subjected to plating in a plating bath having a temperature of 463° C. at a weight of 50 g/m$^2$ per surface and subjected to alloying at a degree of alloying (percent by mass of Fe (Fe content)) of 9% by mass and an alloying temperature of 550° C. or lower. Note that the galvanizing treatment or galvannealing treatment was performed after the temperature was cooled to T° C. shown in Table 2.

In the case where the resulting steel sheet was not subjected to plating, the steel sheet was subjected to skin pass rolling at a rolling reduction (elongation percentage) of 0.3% after the heat treatment. In the case where the resulting steel sheet was subjected to the galvanizing treatment or galvannealing treatment, the steel sheet was subjected to skin pass rolling at a rolling reduction (elongation percentage) of 0.3% after the treatment.

TABLE 1

| Type of steel | C | Si | Mn | Al | P | S | N | Cr | V | Mo | Ti |
|---|---|---|---|---|---|---|---|---|---|---|---|
| A | 0.311 | 1.96 | 1.54 | 0.041 | 0.009 | 0.0024 | 0.0025 | — | — | — | — |
| B | 0.299 | 1.98 | 1.99 | 0.042 | 0.013 | 0.0019 | 0.0034 | — | — | — | — |
| C | 0.305 | 2.52 | 2.03 | 0.043 | 0.010 | 0.0037 | 0.0042 | — | — | — | — |
| D | 0.413 | 2.03 | 1.51 | 0.038 | 0.012 | 0.0017 | 0.0025 | — | — | — | — |
| E | 0.417 | 1.99 | 2.02 | 0.044 | 0.010 | 0.0020 | 0.0029 | — | — | — | — |
| F | 0.330 | 1.45 | 2.82 | 0.040 | 0.012 | 0.0031 | 0.0043 | — | — | — | — |
| G | 0.185 | 1.52 | 2.32 | 0.048 | 0.020 | 0.0050 | 0.0044 | — | — | — | — |
| H | 0.522 | 1.85 | 1.48 | 0.040 | 0.011 | 0.0028 | 0.0043 | — | — | — | — |
| I | 0.355 | 1.02 | 2.20 | 0.039 | 0.015 | 0.0018 | 0.0038 | — | — | — | — |
| J | 0.263 | 1.50 | 2.29 | 0.039 | 0.011 | 0.0010 | 0.0036 | 0.9 | — | — | — |
| K | 0.270 | 1.35 | 2.27 | 0.043 | 0.004 | 0.0020 | 0.0035 | — | 0.21 | — | — |
| L | 0.221 | 1.22 | 1.99 | 0.040 | 0.040 | 0.0030 | 0.0043 | — | — | 0.19 | — |
| M | 0.202 | 1.75 | 2.52 | 0.045 | 0.044 | 0.0020 | 0.0044 | — | — | — | 0.035 |
| N | 0.175 | 1.51 | 2.18 | 0.042 | 0.022 | 0.0020 | 0.0044 | — | — | — | — |
| O | 0.212 | 1.51 | 2.37 | 0.043 | 0.030 | 0.0010 | 0.0029 | — | — | — | 0.020 |
| P | 0.480 | 1.52 | 1.33 | 0.044 | 0.015 | 0.0020 | 0.0038 | — | — | — | — |
| Q | 0.310 | 1.42 | 2.02 | 0.043 | 0.015 | 0.0030 | 0.0023 | — | — | — | — |
| R | 0.335 | 2.01 | 2.22 | 0.043 | 0.004 | 0.0028 | 0.0041 | — | — | — | — |
| S | 0.329 | 1.88 | 1.65 | 0.040 | 0.021 | 0.0020 | 0.0031 | — | — | — | — |
| T | 0.330 | 0.01 | 2.33 | 1.010 | 0.025 | 0.0020 | 0.0033 | — | — | — | — |
| U | 0.291 | — | 2.75 | 0.042 | 0.012 | 0.0040 | 0.0024 | — | — | — | — |
| V | 0.290 | 0.48 | 2.22 | 0.130 | 0.006 | 0.0020 | 0.0035 | — | — | — | — |
| W | 0.145 | 0.50 | 1.42 | 0.320 | 0.007 | 0.0018 | 0.0041 | — | — | — | — |
| X | 0.190 | 1.00 | 0.41 | 0.036 | 0.013 | 0.0020 | 0.0038 | — | — | — | — |

| Type of steel | Nb | B | Ni | Cu | Ca | REM | (% by mass) Si + AI | $A_3$ point (° C.) | Remarks |
|---|---|---|---|---|---|---|---|---|---|
| A | — | — | — | — | — | — | 2.00 | 850 | Steel |
| B | — | — | — | — | — | — | 2.02 | 842 | Steel |
| C | — | — | — | — | — | — | 2.56 | 862 | Steel |
| D | — | — | — | — | — | — | 2.07 | 838 | Steel |
| E | — | — | — | — | — | — | 2.03 | 820 | Steel |
| F | — | — | — | — | — | — | 1.49 | 787 | Steel |
| G | — | — | — | — | — | — | 1.57 | 841 | Steel |
| H | — | — | — | — | — | — | 1.89 | 815 | Steel |
| I | — | — | — | — | — | — | 1.06 | 784 | Steel |
| J | — | — | — | — | — | — | 1.54 | 807 | Steel |
| K | — | — | — | — | — | — | 1.39 | 827 | Steel |
| L | — | — | — | — | — | — | 1.26 | 849 | Steel |
| M | — | — | — | — | — | — | 1.80 | 872 | Steel |
| N | 0.07 | — | — | — | — | — | 1.55 | 848 | Steel |
| O | — | 0.0011 | — | — | — | — | 1.55 | 848 | Steel |
| P | — | — | 0.52 | — | — | — | 1.56 | 806 | Steel |
| Q | — | — | — | 0.55 | — | — | 1.46 | 805 | Steel |

TABLE 1-continued

| | | | | | | | | | |
|---|---|---|---|---|---|---|---|---|---|
| R | — | — | — | — | 0.003 | — | 2.05 | 824 | Steel |
| S | — | — | — | — | — | 0.002 | 1.92 | 848 | Steel |
| T | — | — | — | — | — | — | 1.02 | 873 | Steel |
| U | — | — | — | — | — | — | 0.04 | 732 | Comparative Steel |
| V | — | — | — | — | — | — | 0.61 | 777 | Comparative Steel |
| W | — | — | — | — | — | — | 0.82 | 859 | Comparative Steel |
| X | — | — | — | — | — | — | 1.04 | 868 | Comparative Steel |

Note)

Underlined values are outside the proper range.

TABLE 2

| Sample No. | Type of steel | Presence or absence of coating*2 | Annealing temperature (° C.) | Annealing time (s) | Average cooling rate to T ° C. (° C./s) | Cooling stop temperature T (° C.) | Second temperature range Holding temperature (° C.) | Second temperature range Holding time (s) | Remarks |
|---|---|---|---|---|---|---|---|---|---|
| 1 | A | CR | 870 | 200 | 5 | 200 | 430 | 90 | Comparative Example |
| 2 | A | CR | 900 | 180 | 20 | 390 | 390 | 100 | Comparative Example |
| 3 | A | CR | 920 | 120 | 50 | 20 | 400 | 90 | Comparative Example |
| 4 | A | CR | 920 | 70 | 15 | 250 | 400 | 90 | Example |
| 5 | B | CR | 820 | 180 | 10 | 300 | 410 | 60 | Comparative Example |
| 6 | B | CR | 900 | 170 | 25 | 260 | 420 | 90 | Example |
| 7 | C | CR | 890 | 180 | 25 | 400 | 400 | 120 | Comparative Example |
| 8 | C | CR | 900 | 250 | 30 | 200 | 410 | 90 | Example |
| 9 | C | CR | 900 | 150 | 25 | 190 | 390 | 300 | Example |
| 10 | D | CR | 880 | 280 | 15 | 240 | 400 | 90 | Example |
| 11 | E | CR | 860 | 350 | 28 | 200 | 200 | 90 | Comparative Example |
| 12 | E | CR | 890 | 220 | 35 | 250 | 400 | 120 | Example |
| 13 | E | CR | 900 | 180 | 30 | 140 | 400 | 90 | Example |
| 14 | F | CR | 860 | 290 | 15 | 200 | 380 | 90 | Example |
| 15 | F | GI | 870 | 180 | 15 | 200 | 450 | 90 | Example |
| 16 | G | CR | 900 | 180 | 30 | 250 | 400 | 90 | Example |
| 17 | H | CR | 890 | 200 | 25 | 90 | 380 | 520 | Example |
| 18 | I | CR | 900 | 200 | 20 | 260 | 400 | 100 | Example |
| 19 | I | GA | 890 | 180 | 50 | 250 | 400 | 60 | Example |
| 20 | J | CR | 900 | 200 | 20 | 250 | 370 | 90 | Example |
| 21 | K | CR | 900 | 200 | 40 | 250 | 400 | 90 | Example |
| 22 | L | CR | 900 | 400 | 30 | 250 | 400 | 200 | Example |
| 23 | M | CR | 920 | 200 | 20 | 250 | 400 | 180 | Example |
| 24 | N | CR | 900 | 200 | 20 | 250 | 400 | 100 | Example |
| 25 | O | CR | 900 | 250 | 20 | 240 | 400 | 100 | Example |
| 26 | P | CR | 900 | 180 | 20 | 210 | 400 | 300 | Example |
| 27 | Q | CR | 910 | 180 | 30 | 250 | 420 | 120 | Example |
| 28 | R | CR | 900 | 180 | 30 | 200 | 400 | 100 | Example |
| 29 | S | CR | 900 | 180 | 30 | 230 | 400 | 100 | Example |
| 30 | T | CR | 920 | 200 | 30 | 250 | 400 | 120 | Example |
| 31 | U | CR | 900 | 200 | 13 | 250 | 400 | 100 | Comparative Example |
| 32 | V | CR | 900 | 200 | 20 | 250 | 400 | 100 | Comparative Example |

TABLE 2-continued

| Sample No. | Type of steel | Presence or absence of coating*2 | Annealing temperature (° C.) | Annealing time (s) | Average cooling rate to T ° C. (° C./s) | Cooling stop temperature T (° C.) | Second temperature range Holding temperature (° C.) | Second temperature range Holding time (s) | Remarks |
|---|---|---|---|---|---|---|---|---|---|
| 33 | W | CR | 900 | 200 | 40 | 300 | 400 | 60 | Comparative Example |
| 34 | X | CR | 900 | 200 | 15 | 200 | 400 | 60 | Comparative Example |

*1Underlined values are outside the proper range.
*2CR: Without plating (cold-rolled steel sheet)
GI: Galvanized steel sheet
GA: Galvannealed steel sheet Properties of the resulting steel sheet were evaluated by methods described below.

A sample was cut out from each steel sheet and polished. A surface parallel to the rolling direction was observed with a scanning electron microscope (SEM) at a magnification of 3000× from 10 fields of view. The proportion of the area of each phase was measured to identify the phase structure of each crystal grain.

The retained austenite content was determined as follows: A steel sheet was ground and polished in the thickness direction to have a quarter of the thickness. The retained austenite content was determined by X-ray diffraction intensity measurement with the steel sheet. Co—Kα was used as an incident X-ray. The retained austenite content was calculated from ratios of diffraction intensities of the (200), (220), and (311) planes of austenite to the respective (200), (211), and (220) planes of ferrite.

The average C content of retained austenite was determined as follows: A lattice constant was determined from intensity peaks of the (200), (220), and (311) planes of austenite by the X-ray diffraction intensity measurement. The average C content (% by mass) was determined with the following calculation formula:

$$a_0=0.3580+0.0033\times[\text{C }\%]+0.00095\times[\text{Mn }\%]+0.0056\times[\text{Al }\%]+0.022\times[\text{N }\%]$$

where $a_0$ represents a lattice constant (nm), and [X %] represents percent by mass of element X. Note that percent by mass of an element other than C was defined as percent by mass with respect to the entire steel sheet.

A tensile test was performed according to JIS Z2201 using a No. 5 test piece taken from the steel sheet in a direction perpendicular to the rolling direction. Tensile strength (TS) and total elongation (T. EL) were measured. The product of the strength and the total elongation (TS×T. EL) was calculated to evaluate a balance between the strength and the workability (ductility). Note that in our examples, when TS×T. EL 20,000 (MPa·%), the balance was determined to be satisfactory.

Stretch-flangeability was evaluated in compliance with The Japan Iron and Steel Federation Standard JFST 1001. The resulting steel sheet was cut into a piece having a size of 100 mm×100 mm. A hole having a diameter of 10 mm was made in the piece by punching at a clearance of 12% of the thickness. A cone punch with a 60° apex was forced into the hole while the piece was fixed with a die having an inner diameter of 75 mm at a blank-holding pressure of 88.2 kN. The diameter of the hole was measured when a crack was initiated. The maximum hole-expanding ratio λ (%) was determined with Formula (1):

$$\text{Maximum hole-expanding ratio }\lambda\ (\%)=\{(D_f-D_0)/D_0\}\times 100 \quad (1)$$

where $D_f$ represents the hole diameter (mm) when a crack was initiated; and $D_0$ represents an initial hole diameter (mm).

The product (TS×λ) of the strength and the maximum hole-expanding ratio using the measured λ was calculated to evaluate the balance between the strength and the stretch-flangeability.

Note that in our examples, when TS×λ≥25000 (MPa·%), the stretch-flangeability was determined to be satisfactory.

Furthermore, the hardness of the hardest microstructure in microstructures of the steel sheet was determined by a method described below. From the result of microstructure observation, in the case where as-quenched martensite was observed, ultramicro-Vickers hardness values of 10 points of as-quenched martensite were measured at a load of 0.02 N. The average value thereof was determined as the hardness of the hardest microstructure in the microstructures of the steel sheet. In the case where as-quenched martensite was not present, as described above, any one of microstructure of tempered martensite, upper bainite, and lower bainite was the hardest phase in the steel sheet. In our steel sheets, the hardest phase had a hardness (HV) of 800 or less.

Moreover, a test piece cut out from each steel sheet was observed with a SEM at a magnification of 10,000× to 30,000×. In our steel sheets, $5\times10^4$ or more per square millimeter of an iron-based carbide grains each having a size of 5 nm to 0.5 μm were precipitated in tempered martensite.

Table 3 shows the evaluation results.

TABLE 3

| Sample No. | Type of steel | Proportion of area with respect to all microstructures of steel sheet (%) αb*2 | M*2 | tM*2 | α*2 | γ*2*3 | Balance | αb + M + γ | tM/M (%) |
|---|---|---|---|---|---|---|---|---|---|
| 1 | A | 5 | 2 | 0 | 61 | 3 | 29 | 10 | 0 |
| 2 | A | 49 | 32 | 3 | 2 | 17 | 0 | 98 | 9 |
| 3 | A | 0 | 99 | 99 | 0 | 1 | 0 | 100 | 100 |
| 4 | A | 78 | 10 | 7 | 3 | 9 | 0 | 97 | 70 |
| 5 | B | 10 | 58 | 6 | 22 | 10 | 0 | 78 | 10 |
| 6 | B | 72 | 15 | 8 | 2 | 11 | 0 | 98 | 53 |
| 7 | C | 34 | 48 | 2 | 3 | 15 | 0 | 97 | 4 |
| 8 | C | 58 | 30 | 20 | 1 | 11 | 0 | 99 | 67 |

TABLE 3-continued

| | | | | | | | | | |
|---|---|---|---|---|---|---|---|---|---|
| 9 | C | 45 | 43 | 33 | 0 | 12 | 0 | 100 | 77 |
| 10 | D | 67 | 20 | 15 | 0 | 13 | 0 | 100 | 75 |
| 11 | E | 14 | 82 | 5 | 0 | 4 | 0 | 100 | 6 |
| 12 | E | 54 | 25 | 10 | 0 | 21 | 0 | 100 | 40 |
| 13 | E | 56 | 30 | 21 | 0 | 14 | 0 | 100 | 70 |
| 14 | F | 42 | 48 | 21 | 0 | 10 | 0 | 100 | 44 |
| 15 | F | 50 | 38 | 15 | 0 | 12 | 0 | 100 | 39 |
| 16 | G | 49 | 43 | 12 | 0 | 8 | 0 | 100 | 28 |
| 17 | H | 17 | 77 | 65 | 0 | 6 | 0 | 100 | 84 |
| 18 | I | 40 | 50 | 20 | 0 | 10 | 0 | 100 | 40 |
| 19 | I | 37 | 55 | 18 | 0 | 8 | 0 | 100 | 33 |
| 20 | J | 18 | 72 | 60 | 2 | 8 | 0 | 98 | 83 |
| 21 | K | 22 | 68 | 50 | 0 | 10 | 0 | 100 | 74 |
| 22 | L | 20 | 70 | 48 | 0 | 10 | 0 | 100 | 69 |
| 23 | M | 35 | 57 | 42 | 0 | 8 | 0 | 100 | 74 |
| 24 | N | 32 | 58 | 40 | 0 | 10 | 0 | 100 | 69 |
| 25 | O | 34 | 56 | 42 | 0 | 10 | 0 | 100 | 75 |
| 26 | P | 32 | 54 | 35 | 0 | 14 | 0 | 100 | 65 |
| 27 | Q | 42 | 43 | 31 | 0 | 15 | 0 | 100 | 72 |
| 28 | R | 21 | 69 | 51 | 0 | 10 | 0 | 100 | 74 |
| 29 | S | 58 | 30 | 18 | 0 | 12 | 0 | 100 | 60 |
| 30 | T | 40 | 48 | 25 | 0 | 12 | 0 | 100 | 52 |
| 31 | U | 38 | 45 | 25 | 8 | 2 | 7 | 85 | 56 |
| 32 | V | 42 | 52 | 28 | 3 | 3 | 0 | 97 | 54 |
| 33 | W | 80 | 9 | 4 | 0 | 2 | 9 | 91 | 44 |
| 34 | X | 8 | 0 | — | 70 | 0 | 22 | 8 | — |

| Sample No. | Type of steel | Average C content of retained γ (% by mass) | TS (MPa) | T.EL (%) | λ (%) | TS × T.EL (MPa · %) | TS × λ (MPa · %) | Remarks |
|---|---|---|---|---|---|---|---|---|
| 1 | A | — | 821 | 23 | 39 | 18883 | 32019 | Comparative Example |
| 2 | A | 0.99 | 1201 | 20 | 20 | 23972 | 24020 | Comparative Example |
| 3 | A | — | 1805 | 7 | 29 | 12635 | 52345 | Comparative Example |
| 4 | A | 1.11 | 1382 | 15 | 44 | 20730 | 60808 | Example |
| 5 | B | 0.67 | 1368 | 13 | 4 | 17784 | 5472 | Comparative Example |
| 6 | B | 0.95 | 1371 | 16 | 37 | 21936 | 50727 | Example |
| 7 | C | 0.94 | 1499 | 20 | 2 | 29980 | 2998 | Comparative Example |
| 8 | C | 0.88 | 1474 | 17 | 40 | 25058 | 58960 | Example |
| 9 | C | 0.92 | 1464 | 18 | 42 | 26352 | 61488 | Example |
| 10 | D | 1.18 | 1404 | 20 | 31 | 28080 | 43524 | Example |
| 11 | E | 0.18 | 2234 | 8 | 2 | 17872 | 4468 | Comparative Example |
| 12 | E | 1.00 | 1477 | 22 | 18 | 32494 | 26586 | Example |
| 13 | E | 0.96 | 1634 | 15 | 22 | 24510 | 35948 | Example |
| 14 | F | 0.76 | 1630 | 16 | 19 | 26080 | 30970 | Example |
| 15 | F | 0.81 | 1556 | 15 | 18 | 23340 | 28008 | Example |
| 16 | G | 0.72 | 1201 | 19 | 24 | 22819 | 28824 | Example |
| 17 | H | 1.0 | 1862 | 11 | 17 | 20482 | 31654 | Example |
| 18 | I | 0.85 | 1462 | 15 | 21 | 21930 | 30702 | Example |
| 19 | I | 0.87 | 1410 | 15 | 19 | 21150 | 26790 | Example |
| 20 | J | 0.79 | 1762 | 13 | 17 | 22906 | 29954 | Example |
| 21 | K | 0.81 | 1605 | 14 | 18 | 22470 | 28890 | Example |
| 22 | L | 0.72 | 1850 | 11 | 15 | 20350 | 27750 | Example |
| 23 | M | 0.82 | 1294 | 18 | 22 | 23292 | 28468 | Example |
| 24 | N | 0.77 | 1027 | 25 | 40 | 25675 | 41080 | Example |
| 25 | O | 0.84 | 1258 | 21 | 30 | 26418 | 37740 | Example |
| 26 | P | 0.91 | 1755 | 15 | 19 | 26325 | 33345 | Example |
| 27 | Q | 0.92 | 1572 | 16 | 22 | 25152 | 34584 | Example |
| 28 | R | 0.91 | 1472 | 15 | 39 | 22080 | 57408 | Example |
| 29 | S | 1.06 | 1432 | 18 | 30 | 25776 | 42960 | Example |
| 30 | T | 1.03 | 1352 | 19 | 35 | 25688 | 47320 | Example |
| 31 | U | — | 1156 | 12 | 25 | 13872 | 28900 | Comparative Example |
| 32 | V | — | 1286 | 12 | 24 | 15432 | 30864 | Comparative Example |
| 33 | W | — | 886 | 15 | 36 | 13290 | 31896 | Comparative Example |
| 34 | X | — | 720 | 14 | 32 | 10080 | 23040 | Comparative Example |

*[1]Underlined values are outside the proper range.

*[2]αb: Bainitic ferrite in upper bainite

M: Martensite tM: Tempered martensite

α: Polygonal ferrite

γ: Retained austenite

*[3]The amount of retained austenite determined by X-ray diffraction intensity measurement was defined as the proportion of area with respect to all microstructure of steel sheet.

As is apparent from Table 3, it was found that our steel sheets satisfied a tensile strength of 980 MPa or more, a value of TS×T. EL of 20,000 MPa·% or more, and a value of TS×λ of 25,000 MPa·% or more and thus had high strength and good workability, in particular, good stretch-flangeability.

In contrast, in sample 1, desired microstructures of the steel sheet were not obtained because the average cooling rate to the first temperature range was outside the proper range. The value of TS×λ satisfied 25,000 MPa·% or more, and stretch-flangeability was good. However, the tensile strength (TS) did not reach 980 MPa. The value of TS×T. EL was less than 20,000 MPa·%. In each of samples 2, 3, and 7, desired microstructures of the steel sheet were not obtained because the cooling stop temperature T was outside the first temperature range. Although the tensile strength (TS) satisfied 980 MPa or more, TS×T. EL≥20,000 MPa·% or TS×λ≥25,000 MPa·% was not satisfied. In sample 5, desired microstructures of the steel sheet were not obtained because the annealing temperature was less than the $A_3$ transformation point. In sample 11, desired microstructures of the steel sheet were not obtained because the holding time in the second temperature range was outside the proper range. In each of samples 5 and 11, although the tensile strength (TS) satisfied 980 MPa, TS×T. EL≥20,000 MPa·% and TS×λ≥25,000 MPa·% were not satisfied. In each of samples 31 to 34, desired microstructures of the steel sheet were not obtained because the component composition was outside our proper range. At least one selected from a tensile strength (TS) of 980 MPa or more, a value of TS×T. EL of 20,000 MPa·%, and a value of TS×λ of 25,000 MPa·% was not satisfied.

Example 2

Cast slabs obtained by refining steels, i.e., the types of steel of a, b, c, d, and e shown in Table 4, were heated to 1200° C. Hot-rolled steel sheets were subjected to finish hot rolling at 870° C., wound at 650° C., pickling, and cold rolling at a rolling reduction of 65% to form cold-rolled steel sheets each having a thickness of 1.2 mm. The resulting cold-rolled steel sheets were subjected to heat treatment under conditions shown in Table 5. Furthermore, the steel sheets after the heat treatment were subjected to skin pass rolling at a rolling reduction (elongation percentage) of 0.5%. Note that the $A_3$ point shown in Table 4 was determined with the formula described above. The Ms point shown in Table 5 indicates the martensitic transformation start temperature of each type of steel and was measured by the Formaster test. Furthermore, in Table 5, Example 1 is one of our examples in which the first temperature range (cooling stop temperature) is less than Ms−100° C. Example 2 is one of our examples in which the first temperature range (cooling stop temperature) is (Ms−100° C.) or more and less than Ms.

TABLE 4

| Type of steel | C | Si | Mn | Al | P | S | N | Si + Al | $A_3$ point (° C.) |
|---|---|---|---|---|---|---|---|---|---|
| | | | | | | | | (% by mass) | |
| a | 0.413 | 2.03 | 1.51 | 0.038 | 0.012 | 0.0017 | 0.0025 | 2.07 | 838 |
| b | 0.417 | 1.99 | 2.02 | 0.044 | 0.010 | 0.0020 | 0.0029 | 2.03 | 820 |
| c | 0.522 | 1.85 | 1.48 | 0.040 | 0.011 | 0.0028 | 0.0043 | 1.89 | 815 |
| d | 0.314 | 2.55 | 2.03 | 0.041 | 0.011 | 0.0020 | 0.0028 | 2.59 | 862 |
| e | 0.613 | 1.55 | 1.54 | 0.042 | 0.012 | 0.0022 | 0.0026 | 1.59 | 788 |

TABLE 5

| Sample No. | Type of steel | Annealing temperature (° C.) | Annealing time (s) | Average cooling rate to first temperature range (° C./s) | Cooling stop temperature (° C.) | Holding temperature in second temperature range (° C.) | Holding time in second temperature range (s) | Ms (° C.) | Ms-100° C. (° C.) | Remarks |
|---|---|---|---|---|---|---|---|---|---|---|
| 35 | a | 880 | 280 | 15 | 240 | 400 | 90 | 275 | 175 | Example 2 |
| 36 | b | 890 | 220 | 35 | 250 | 400 | 120 | 265 | 165 | Example 2 |
| 37 | b | 900 | 180 | 30 | 140 | 400 | 90 | 265 | 165 | Example 1 |
| 38 | c | 890 | 200 | 25 | 90 | 380 | 520 | 230 | 130 | Example 1 |
| 39 | d | 920 | 150 | 35 | 250 | 400 | 90 | 290 | 190 | Example 2 |
| 40 | d | 900 | 200 | 35 | 210 | 410 | 300 | 290 | 190 | Example 2 |
| 41 | d | 900 | 180 | 35 | 150 | 400 | 500 | 290 | 190 | Example 1 |
| 42 | c | 890 | 180 | 30 | 200 | 400 | 300 | 230 | 130 | Example 2 |
| 43 | e | 880 | 400 | 30 | 200 | 400 | 300 | 225 | 125 | Example 2 |

Microstructures, the average C content of retained austenite, the tensile strength (TS), T. EL (total elongation), and stretch-flangeability of the resulting steel sheets were evaluated as in Example 1.

A test piece cut out from each steel sheet was observed with a SEM at a magnification of 10,000× to 30,000× to check the formation state of the iron-based carbide in tempered martensite. Tables 6 and 7 show the evaluation results.

TABLE 6

| Sample No. | Type of steel | αb | M | tM | α | γ | Balance | αb + M + γ | tM/M (%) | Average C content of retained γ (% by mass) | Iron-based carbide in tM (number/mm$^2$) | Remarks |
|---|---|---|---|---|---|---|---|---|---|---|---|---|
| 35 | a | 67 | 20 | 15 | 0 | 13 | 0 | 100 | 75 | 1.18 | $1 \times 10^6$ | Example 2 |
| 36 | b | 54 | 25 | 10 | 0 | 21 | 0 | 100 | 40 | 1.00 | $2 \times 10^6$ | Example 2 |
| 37 | b | 56 | 30 | 21 | 0 | 14 | 0 | 100 | 70 | 0.96 | $1 \times 10^6$ | Example 1 |
| 38 | c | 17 | 77 | 65 | 0 | 6 | 0 | 100 | 84 | 1.03 | $3 \times 10^6$ | Example 1 |
| 39 | d | 55 | 30 | 18 | 0 | 15 | 0 | 100 | 60 | 0.87 | $4 \times 10^5$ | Example 2 |
| 40 | d | 52 | 36 | 24 | 0 | 12 | 0 | 100 | 67 | 0.91 | $5 \times 10^5$ | Example 2 |
| 41 | d | 43 | 47 | 38 | 0 | 10 | 0 | 100 | 81 | 0.87 | $8 \times 10^5$ | Example 1 |
| 42 | c | 45 | 38 | 35 | 0 | 17 | 0 | 100 | 92 | 1.19 | $3 \times 10^6$ | Example 2 |
| 43 | e | 55 | 25 | 24 | 0 | 20 | 0 | 100 | 96 | 1.40 | $5 \times 10^6$ | Example 2 |

αb: Bainitic ferrite in upper bainite
M: Martensite
tM: Tempered martensite
α: Polygonal ferrite
γ: Retained austenite
Grain diameter of iron-based carbide: 5 nm to 0.5 μm

TABLE 7

| Sample No. | Type of steel | TS (MPa) | T.EL (%) | λ (%) | TS × T.EL (MPa · %) | TS × λ (MPa · %) | Remarks |
|---|---|---|---|---|---|---|---|
| 35 | a | 1404 | 20 | 31 | 28080 | 43524 | Example 2 |
| 36 | b | 1477 | 22 | 18 | 32494 | 26586 | Example 2 |
| 37 | b | 1634 | 15 | 22 | 24510 | 35948 | Example 1 |
| 38 | c | 1862 | 11 | 17 | 20482 | 31654 | Example 1 |
| 39 | d | 1423 | 20 | 34 | 28460 | 48382 | Example 2 |
| 40 | d | 1483 | 17 | 39 | 25211 | 57837 | Example 2 |
| 41 | d | 1546 | 14 | 42 | 21644 | 64932 | Example 1 |
| 42 | c | 1567 | 18 | 17 | 28206 | 26639 | Example 2 |
| 43 | e | 1530 | 18 | 17 | 27540 | 26010 | Example 2 |

All steel sheets shown in Tables 6 and 7 were within our range. It was found that each of the steel sheets satisfied a tensile strength of 980 MPa or more, a value of TS×T. EL of 20,000 MPa·% or more, and a value of TS×λ of 25,000 MPa·% or more and thus had high strength and good workability, in particular, good stretch-flangeability. In each of samples 35, 36, 39, 40, 42, and 43 (Example 2) in which the first temperature range (cooling stop temperature) was (Ms−100° C.) or more and less than Ms, the stretch-flangeability was slightly inferior to those of samples 37, 38, and 41 (Example 1) in which the first temperature range (cooling stop temperature) was less than Ms−100° C. However, the value of TS×T. EL was 25,000 MPa·% or more. It was found that the samples had an extremely satisfactory balance between strength and ductility.

INDUSTRIAL APPLICABILITY

The C content of a steel sheet is set to 0.17% or more, which is a high C content. Proportions of areas of martensite, tempered martensite, and bainitic ferrite in upper bainite with respect to all microstructures of the steel sheet, retained austenite content, and the average C content of retained austenite are specified. As a result, it is possible to provide a high-strength steel sheet having good workability, in particular, good ductility and stretch-flangeability, and having a tensile strength (TS) of 980 MPa or more.

The invention claimed is:

1. A high-strength steel sheet comprising, on a mass percent basis:

0.17%-0.73% C;
3.0% or less Si;
0.5%-3.0% Mn;
0.1% or less P;
0.07% or less S;
3.0% or less Al;
0.010% or less N; and
the balance being Fe and incidental impurities, wherein Si+Al satisfies 0.7% or more, and
wherein with respect to microstructures of the steel sheet, a proportion of an area of martensite is 10% to 90% with respect to all microstructures of the steel sheet, retained austenite content is 6% to 50%, a proportion of an area of bainitic ferrite in upper bainite is 5% or more with respect to all microstructures of the steel sheet, 25% or more of the martensite is tempered martensite, the sum of the proportion of the area of martensite with respect to all microstructures of the steel sheet, the retained austenite content, and the proportion of the area of bainitic ferrite in upper bainite with respect to all microstructures of the steel sheet satisfies 65% or more, a proportion of an area of polygonal ferrite with respect to all microstructures of the steel sheet satisfies 10% or less (including 0%), average C content of retained austenite is 0.70% or more, tensile strength is 980 MPa to 1862 MPa, and ductility TS×T. EL of 20,000 MPa % to 32,494 MPa %.

2. The high-strength steel sheet according to claim 1, wherein $5 \times 10^4$ or more per square millimeter of iron-based carbide grains each having a size of 5 nm to 0.5 μm are precipitated in tempered martensite.

3. The high-strength steel sheet according to claim 1, further comprising, on a mass percent basis, one or two or more selected from the group consisting of:

0.05%-5.0% Cr;
0.005%-1.0% V; and
0.005%-0.5% Mo,
with the proviso that the C content is 0.17% or more and less than 0.3%.

4. The high-strength steel sheet according to claim 1, further comprising, on a mass percent basis, one or two selected from the group consisting of:

0.01%-0.1% Ti; and
0.01%-0.1% Nb.

5. The high-strength steel sheet according to claim 1, further comprising, on a mass percent basis, 0.0003%-0.0050% B.

6. The high-strength steel sheet according to claim 1, further comprising, on a mass percent basis, one or two selected from the group consisting of:

0.05%-2.0% Ni; and 0.05%-2.0% Cu.

7. The high-strength steel sheet according to claim 1, further comprising, on a mass percent basis, one or two selected from the group consisting of:

0.001%-0.005% Ca; and 0.001%-0.005% REM.

8. A high-strength steel sheet comprising a hot-dip zinc coating layer or an alloyed hot-dip zinc coating layer on a surface of the steel sheet according to claim 1.

9. The high-strength steel sheet according to claim 2, further comprising, on a mass percent basis, one or two or more selected from the group consisting of:

0.05%-5.0% Cr;

0.005%-1.0% V; and 0.005%-0.5% Mo, with the proviso that the C content is 0.17% or more and less than 0.3%.

10. The high-strength steel sheet according to claim 2, further comprising, on a mass percent basis, one or two selected from the group consisting of:

0.01%-0.1% Ti; and 0.01%-0.1% Nb.

11. The high-strength steel sheet according to claim 3, further comprising, on a mass percent basis, one or two selected from the group consisting of:

0.01%-0.1% Ti; and 0.01%-0.1% Nb.

12. The high-strength steel sheet according to claim 2, further comprising, on a mass percent basis, 0.0003%-0.0050% B.

13. The high-strength steel sheet according to claim 3, further comprising, on a mass percent basis, 0.0003%-0.0050% B.

14. The high-strength steel sheet according to claim 4, further comprising, on a mass percent basis, 0.0003%-0.0050% B.

15. The high-strength steel sheet according to claim 2, further comprising, on a mass percent basis, one or two selected from the group consisting of:

0.05%-2.0% Ni; and 0.05%-2.0% Cu.

16. The high-strength, steel sheet according to claim 3, further comprising, on a mass percent basis, one or two selected from the group consisting of:

0.05%-2.0% Ni; and 0.05%-2.0% Cu.

17. The high-strength steel sheet according to claim 1, having a hole-expanding ratio (λ) of 15-44%.

* * * * *